United States Patent [19]

Hse

[11] Patent Number: 4,724,734

[45] Date of Patent: Feb. 16, 1988

[54] MULTIPURPOSE PUNCHER

[76] Inventor: Park-Son Hse, No. 20, Lane 105, Sec. 1, Pei-Yi Road, Hsin-Tien City, Taipei Hsien, Taiwan

[21] Appl. No.: 47,975

[22] Filed: May 7, 1987

[51] Int. Cl.[4] ..... B26F 1/04

[52] U.S. Cl. ..... 83/549; 83/571

[58] Field of Search ..... 83/549, 571

[56] References Cited

U.S. PATENT DOCUMENTS

| | | | |
|---|---|---|---|
| 2,534,094 | 12/1950 | Yerkes | 83/549 X |
| 2,781,096 | 2/1957 | Garity | 83/571 X |
| 3,392,913 | 7/1968 | Neilsen | 83/549 X |
| 4,449,436 | 5/1984 | Semerjian et al. | 83/571 |

FOREIGN PATENT DOCUMENTS

| | | | |
|---|---|---|---|
| 740305 | 11/1955 | United Kingdom | 83/549 |

*Primary Examiner*—Donald R. Schran

*Attorney, Agent, or Firm*—McGlew and Tuttle

[57] ABSTRACT

A multipurpose puncher includes a pair of opposed stationary punch units positioned separately on a base, and a movable punch unit mounted slidably between the stationary punch units on the base. A press lever assembly is arranged so that it always associates with the movable punch unit and one of the stationary punch units to form a two-hole puncher while the other of the stationary punch units can be used as a single hole puncher. Furthermore, as desired, the press lever assembly can be adjusted to associate with all of the three punch units to form a three-hole puncher. When the two-hole puncher is formed, the distance between the axes of the punch members can be adjusted to be 78.5 mm. In addition, when the three-hole puncher is formed, the distance between any two adjacent punch members is preferably 108.5 mm.

4 Claims, 10 Drawing Figures

MULTIPURPOSE PUNCHER

BACKGROUND OF THE INVENTION

The present invention relates to a puncher, and more particularly to a multipurpose convertible puncher to be used as a single hole puncher, a two-hole puncher in which the punch members are spaced from each other at an appropriate distance, or a three-hole puncher in which any two adjacent punch members are spaced from each other at another appropriate distance.

Conventional punchers are classified into three types, i.e. single hole puncher, two-hole puncher, and three-hole puncher. In a puncher, the standard distance between the axes of two adjacent punch members is 78.5 mm for a two-hole puncher and 108.5 mm for a three-hole puncher. When the number of holes punched in a paper is desired to be changed, the puncher must be displaced. Thus, a convertible puncher that easily converts into any of the above-mentioned three types is preferred.

SUMMARY OF THE INVENTION

It is therefore an object of the present invention to provide a multipurpose puncher that converts easily for use as a single hole puncher, a two-hole puncher, or a three-hole puncher.

According to the present invention, the multipurpose puncher includes a base, first and second stationary punch units positioned separately on the base, and a movable punch unit interdisposed slidably between the stationary punch units on the base and slidable between first and second positions.

Each of the stationary punch units includes a support frame fixed on the base, a press lever pivoted on the support frame at an end thereof, means for biasing the free end of the press lever upwardly to an idle position, and an upright punch member secured to the press lever and drivable by the press lever to move up and down. The movable punch unit is similar to the stationary punch units in construction except that the support frame is slidable on the base.

The press lever of the movable punch unit always connects with the press lever of the first stationary punch unit so that the punch member of the first stationary punch unit can be moved downwardly along with the punch member of the movable punch unit as long as either of the press levers of the movable punch unit and the first stationary punch unit is depressed, therefore forming a two-hole puncher from the first stationary punch unit and the movable punch unit. Simultaneously, since the press lever of the second stationary punch unit disconnects from the press lever of the movable punch unit, the second stationary punch unit can be used as a single hole puncher. Additionally, at the time of forming the two-hole puncher, when the movable punch unit is moved to the first position, the distance between the axes of the punch members of the movable punch unit and the first stationary punch unit is 78.5 mm which is standard for the conventional two-punch punchers.

Alternatively, when the movable punch unit is moved to the second position, the press lever of the movable punch unit will be moved to interconnect the press levers of the first and second stationary punch units so that the punch member of the movable punch unit can be moved downwardly along with the punch members of the first and second stationary punch units as long as the press lever of any of the three punch units is depressed, therefore forming a three-hole puncher. At the time of forming the three-hole puncher, the axes of any adjacent two of the three punch members are spaced from each other at a distance of 108.5 mm which is standard for the conventional three-hole punchers.

BRIEF DESCRIPTION OF THE DRAWINGS

Other features and advantages of the present invention will become apparent from the following detailed description by way of one example of a preferred but not a sole form of embodiment with reference to the accompanying drawings, in which.

DETAILED DESCRIPTION OF THE PREFERRED EMBODIMENT

Figure 1:
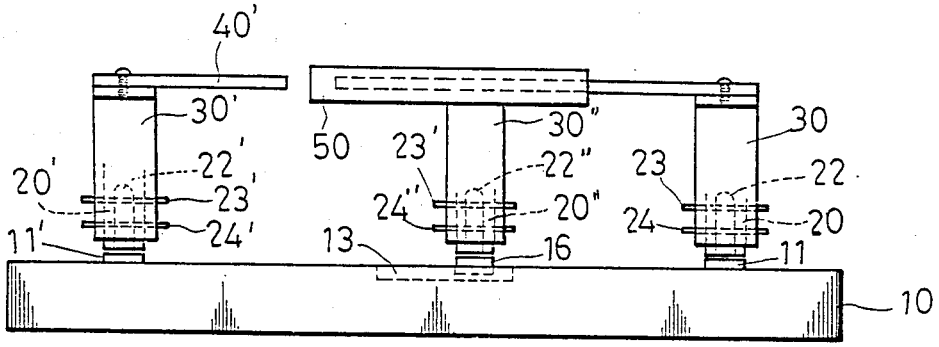
FIG. 1 is a front elevational view of a multipurpose puncher according to the present invention.
Figure 2:
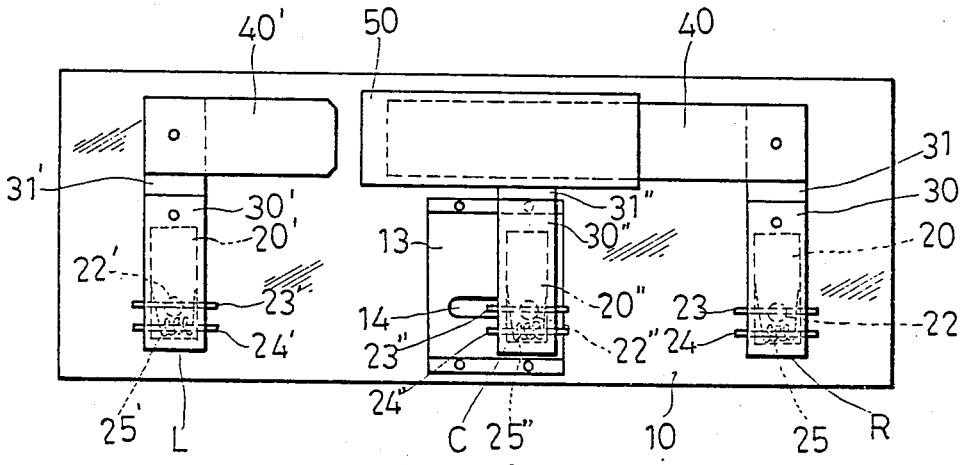
FIG. 2 is a top elevational view of the multipurpose puncher according to the present invention.
Figure 3:
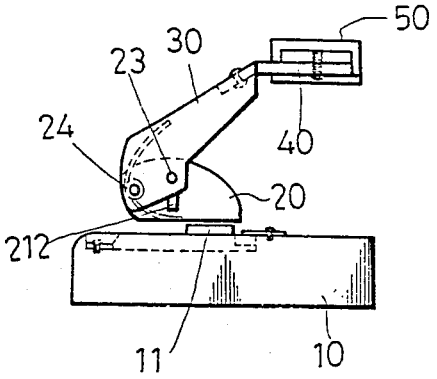
FIG. 3 is a right elevational view of the multipurpose puncher according to the present invention.

Referring to FIGS. 1 through 3, there is shown a multipurpose puncher according to the present invention. The multipurpose puncher includes a base 1 with a right bearing bed 11 and a left bearing bed 11', a right stationary punch unit R, a left stationary punch unit L, and a central movable punch unit C.

The right stationary punch unit R includes a right support frame 20 fixed on the base 10 and having a right longitudinal slide slot 212 therein, a right press lever 30 pivoted on the right support frame 20 at an end thereof by a first pin 24, a right abutment member 40 secured to the right press lever 30, a right punch member 22 secured to the right press lever 30 by a secod pin 23 received in the right longitudinal slide slot 212, and a right spring 25 for biasing the free end of the right press lever 30 upwardly.

The left stationary punch unit L is similar to the right stationary punch unit R in construction except that the left abutment member 40' is longer than the right abutment member 40. That is, it includes a left support frame 20', a left press lever 30', a left abutment member 40', a left longitudinal slide slot (not shown), a left punch member 22', two pins 24' and 23', and a left spring 25'.

Similarly, the central movable punch unit C also includes a central support frame 20'', a central press lever 30'', a central longitudinal slide slot (not shown), a central punch member 22", two pins 24" and 23", and a central spring 25". In addition, also provided is a rectangular sleeve 50 always sleeved on the right abutment member 40 and capable of being moved to the left so as to engage with the left abutment member 40'. In the drawings, the sleeve 50 is disengaged from the left abutment member 40'.

Figure 4:
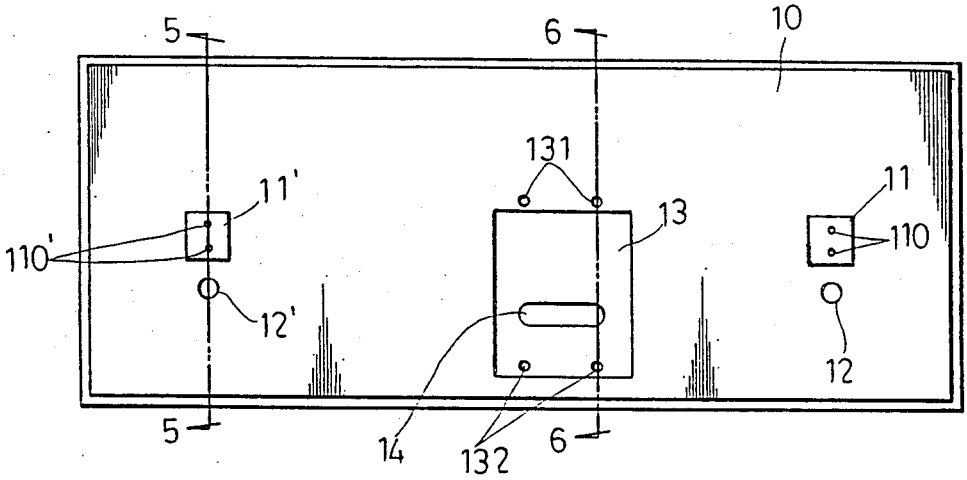
FIG. 4 is a top elevational view showing the base of the multipurpose puncher according to the present invention.
Figure 5:
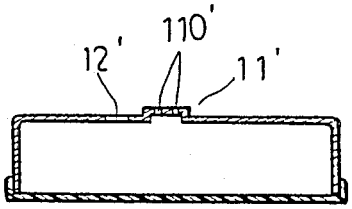
FIG. 5 is a sectional view taken along the line 5—5 of FIG. 4.
Figure 6:
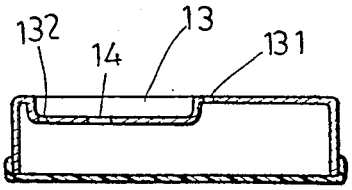
FIG. 6 is a sectional view taken along the line 6—6 of FIG. 4.
Figure 7:
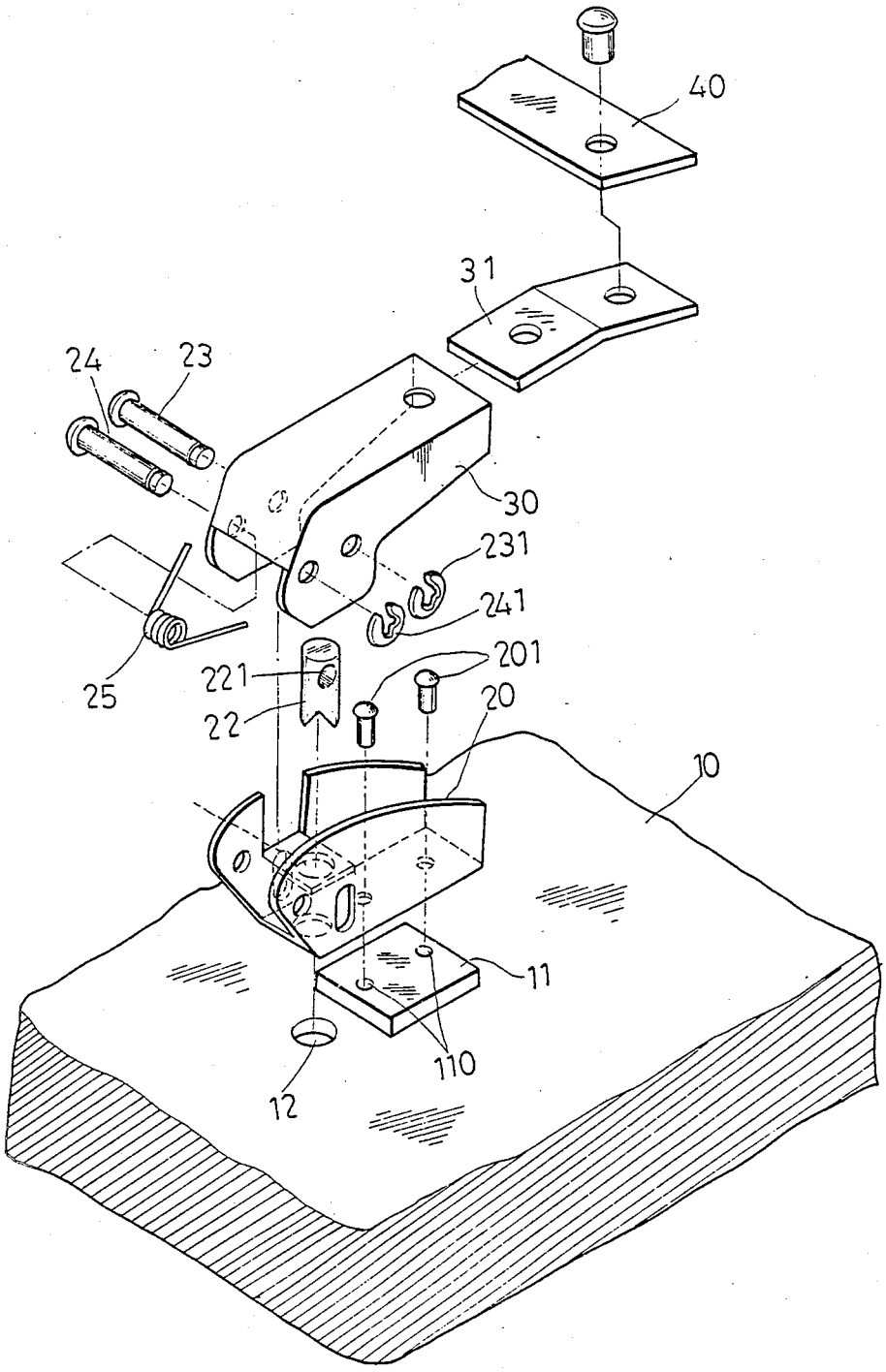
FIG. 7 is an exploded view showing the right stationary punch unit of the multipurpose puncher according to the present invention.
Figure 8:
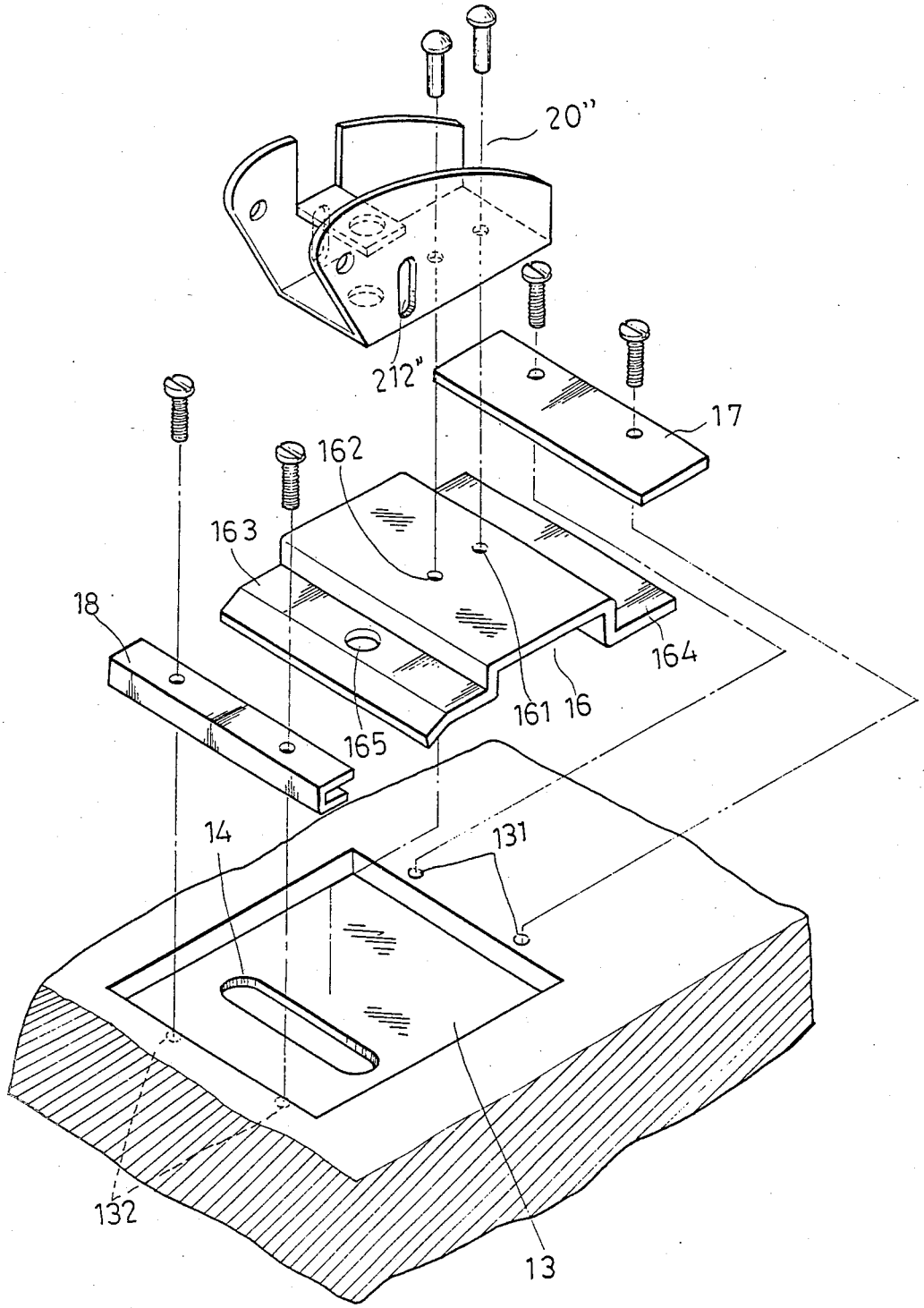
FIG. 8 is an exploded view illustrating the arrangement of the movable support frame of the multipurpose puncher according to the present invention.

Referring to FIGS. 4 through 6 with reference to FIGS. 7 and 8, provided in the base 1 are a pair of right rivet holes 110 provided in the right bearing bed 11, a pair of left rivet holes 110' provided in the left bearing bed 11', a right discharge hole 12 provided in front of the right bearing bed 11 and opposing the right punch member 22 for the entrance of the circular paper wastes carried on the lower end of the right punch member 22, a left discharge hole 12' provided in front of the left bearing bed 11' and opposing the left punch member 22' for the entrance of the circular paper wastes carried on the lower end of the left punch member 22', a rectangular slide slot 13 provided between the right and left bearing beds 11 and 11", an elliptic central discharge hole 14 provided in the rectangular slide slot 13 for the entrance of the circular paper wasters carried on the lower end of the central punch member 22", a pair of rear tap holes 131 provided behind the rectangular slide slot 13, and a pair of front tap holes 132 provided in the rectangular slide slot 13.

In assembly of the right stationary punch unit R, referring to FIG. 5, the right support frame 20 is riveted to the right bearing bed 11 by a pair of rivets 201. The right press lever 30 is pivoted on the right support frame 20 by first pin 24 and a locking element 241 clamping on the first pin 24. The right punch member 22 has a circular hole 221 for insertion of the second pin 23 therethrough, so that the right punch member 22 can be secured to the right press lever 30 by the secod pin 23 and another locking element 231 clamping on the second pin 23. When the right press lever 30 is depressed, the second pin 23 will slide downwardly along the right longitudinal slot 212. In addition to the right longitudinal slot 212, also provided in the right support frame 20 is a longitudinal through hole 211 along which the right punch member 22 can be moved downwardly.

Sleeved on the first pin 23 is the right spring 25 for biasing the second pin 24 upwardly in the right support frame 20 so that the free end of the right press lever 30 is normally biased to the idle position as shown in FIG. 3. The right abutment member 40 is connected to the right press lever 30 by a connecting plate 31 having a pair of circular holes. The connecting plate 31 can be fastened to the right press lever 30 and the right abutment member 40 by screws or rivets. Naturally, as illustrated, each of the left stationary punch unit L and the central movable punch unit C can be assmbled in a manner the same as that of the right stationary punch unit R.

Referring to FIG. 8, the central support frame 20" is mounted slidably on the base 1 by a front guide plate 18, a rear guide plate 17, and a slide plate 16. The front guide plate 18 is screwed to the base 1 in the rectangular slide slot 13 through the front tap holes 132 to form a front guide way. The rear guide plate 17 is screwed to the base 1 through the rear tap holes 131 to form a rear guide way. The slide plate 16 has two bent feet 163 and 164 for sliding insertably along the front and rear guide ways. Provided in the slide plate 16 are a pair of rivet holes 161 and 162 through which the central support frame 20" is riveted to the slide plate 16, and a circular central discharge hole 165 provided on the foot 163 and opposing the central punch member 22" for passage of the central punch member 22" therethrough.

Figure 9:
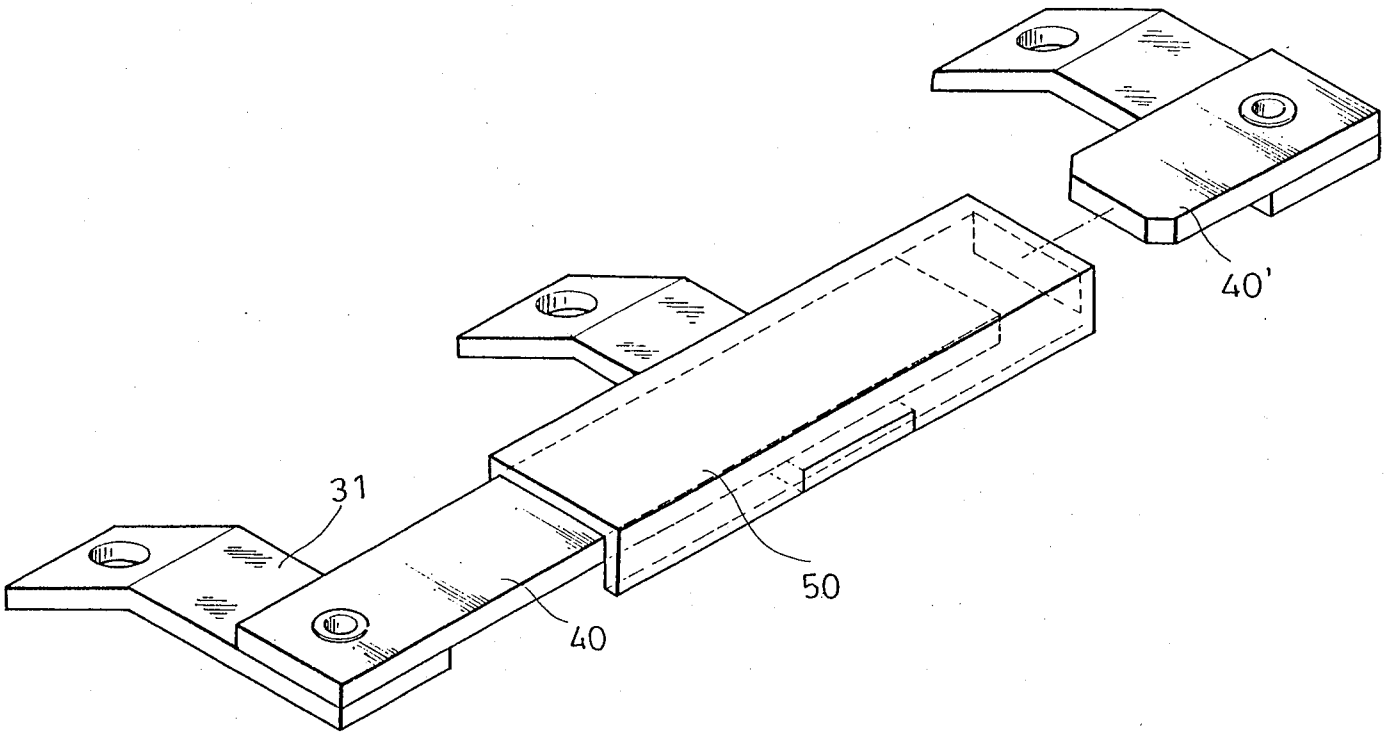
FIG. 9 is a perspective view showing the press lever assembly of the multipurpose puncher according to the present invention, viewed from the top.
Figure 10:
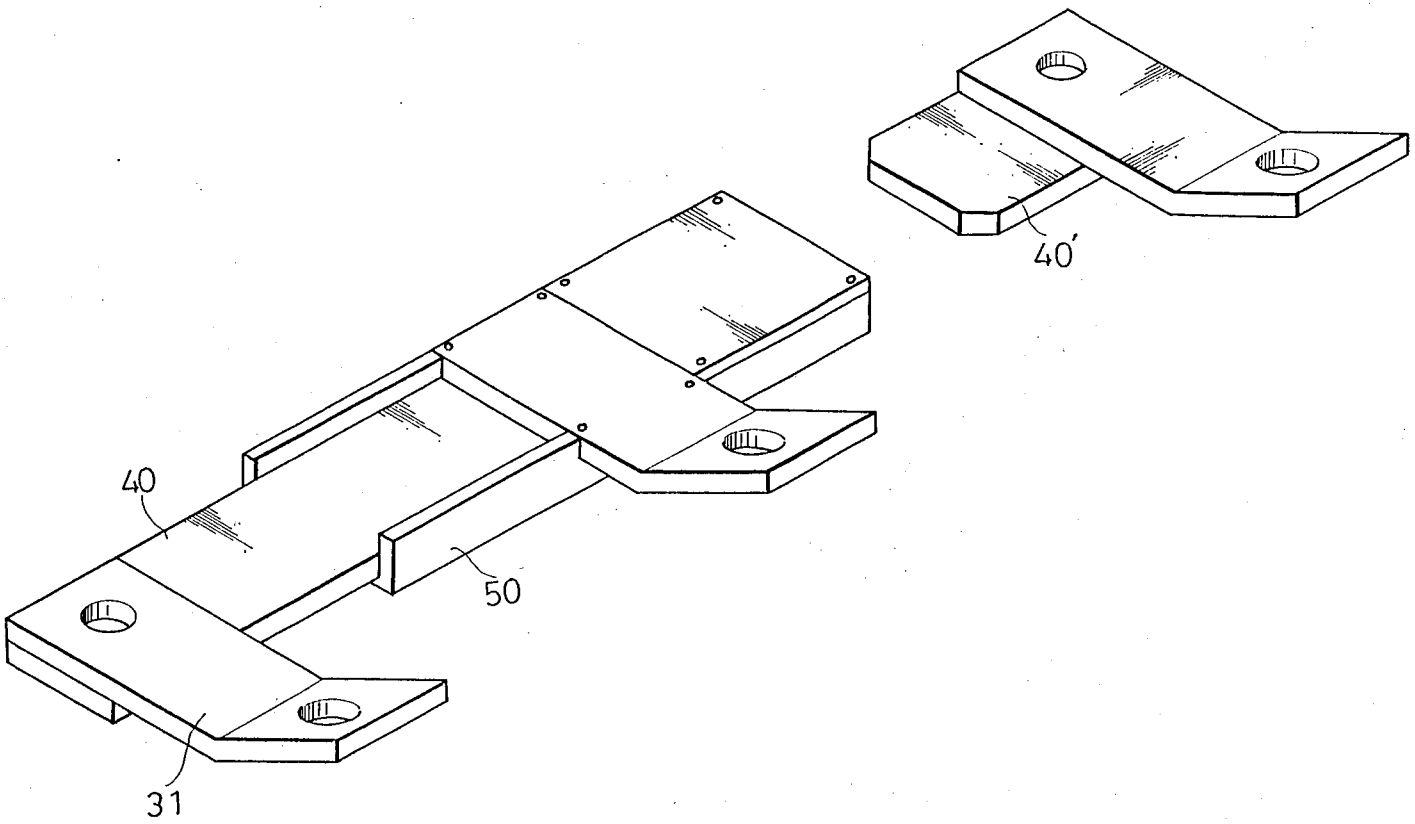
FIG. 10 is a perspective view showing the press lever assembly of the multipurpose puncher according to the present invention, viewed from the bottom.

As best seen from FIGS. 9 and 10, it is understood that when either the sleeve 50 or the right abutment member 40 is depressed, both of them will move downwardly together to form a two-hole puncher. Similarly, when both the left and right abutment members 40 are inserted into the sleeve 50, all of the sleeve 50 and the abutment members 40 and 40' can be moved downwardly together as long as any of them is depressed, therefore forming a three-hole puncher.

The relationship among the punch members 22, 22', and 22" will be described hereinafter. When the slide plate 16 is moved to the rightmost of the rectangular slide slot 13, and when the central punch member 22" is moved downwardly through the elliptic discharge hole 14, the central punch member 22" is positioned in the rightmost of the elliptic discharge hole 14 so that the distance between the axes of the punch members 22 and 22" is 78.5 mm which is standard for the conventional two-hole punchers. Also, when the slide plate 16 is moved to the leftmost of the rectangular slide slot 13, and when the central punch member 22" is moved downwardly through the elliptic discharge hole 14, the central punch member 22" is positioned in the leftmost of the elliptic discharge hole 14 so that the distance between the axes of the central punch member 22" and the left punch member 22' and between the axes of the central punch member 22" and the right punch member 22 is 108.5 mm which is standard for conventional three-hole punchers.

The right and left abutment members 40, 40' and the sleeve 50 are sized so that when the slide plate 16 is moved to the rightmost of the rectangular slide slot 13, the sleeve 50 is spaced from the left abutment member 40' at an appropriate distance to form a two-hole puncher in which the distance between the punch members is 78.5 mm, and when the slide plate 16 is moved to the leftmost of the rectangular slide slot 13, the sleeve 50 will engage with the left abutment member 40' to form a three-hole puncher in which the distance between any two adjacent punch members is 108.5 mm.

In view of the foregoing, in operation, when the slide plate 16 is moved to the rightmost of the rectangular slide slot 13, the sleeve 50 still engages with only the right abutment member 40 to form a two-hole puncher. At the time of forming the two-hole puncher, the left abutment member 40' disengages from the sleeve 50 to form a single hole puncher. In addition, when the slide plate 16 is moved to the leftmost of the rectangular slide slot 13, a three-hole puncher is formed, as described hereinbefore. According to the present invention, a puncher is thus easily convertible for use as a single hole puncher, a two-hole puncher, and a three-hole puncher.

With the present invention thus explained, it is apparent that various modifications and variations can be made without departing from the scope and spirit of the present invention. It is therefore intended that the present invention be limited as indicated in the appended claims.

What is claimed is:

1. A multipurpose puncher comprising:

a base;

a first stationary punch unit including a first support frame fixed on said base, a first press lever pivoted on said first support frame at an end thereof, means for biasing the free end of said first press lever upwardly to a first idle position, and a first punch member secured to said first press lever and drivable by said first press lever to move up and down;

a second stationary punch unit opposing said first stationary punch unit on said base and including a second support frame fixed on said base and spaced from said first support frame, a second press lever pivoted on said second support frame at an end thereof, means for biasing the free end of said second press lever upwardly to a second idle position, and a second punch member secured to said second support frame and drivable by said second press lever to move up and down;

a movable punch unit including a third support frame interdisposed slidably between said first and second support frames on said base and slidable between first and second positions spaced from each other at a first predetermined distance, a third press lever pivoted on said third support frame at an end thereof, means for biasing the free end of said third press lever upwardly to a third idle position, and a third punch member secured to said third press lever and drivable by said third press lever to move up and down, said third punch member being spaced from said first punch member at a second predetermined distance and from said second punch member at a third predetermined distance when said third support frame is positioned on said base, said third press lever being always connected to said first press lever and adjustable to interconnect said first and second press levers;

whereby, when said second press lever connects with only said first press lever, said first punch member can be moved downwardly along with said third punch member as long as either of said first and third press levers is depressed, therefore forming a two-hole puncher from said first stationary punch unit and said movable punch units, while said second press lever disconnects from said first press lever so that said second stationary punch unit can be used as a single hole punch; when said third press lever is moved to interconnect said first and second press levers, both said first and second punch members can be moved downwardly along with said third punch member as long as any of said first, second, and third press levers is depressed, therefore forming a three-hole puncher.

2. A multipurpose puncher as claimed in claim 1, wherein the axes of said first and third punch members are spaced from each other at a distance of 78.5 mm when said movable punch unit is moved to the first position.

3. A multipurpose puncher as claimed in claim 1, wherein the axes of any adjacent two of said first, second, and third punch members are spaced from each other at a distance of 108.5 mm when said movable punch unit is moved to the second position.

4. A multipurpose puncher as claimed in claim 1, wherein said third press lever carries a sleeve thereon, and wherein said first and second press levers respectively carry a first and second abutment member, said sleeve is always sleeved on said first abutment member and capable of being moved relative to the same so as to be also sleeved on said second abutment member when said movable punch unit is moved to the second position.

* * * * *